US006464809B2

(12) United States Patent
Kamf et al.

(10) Patent No.: US 6,464,809 B2
(45) Date of Patent: Oct. 15, 2002

(54) PROCESSES FOR PRODUCING ARTICLES WITH STRESS-FREE SLIT EDGES

(75) Inventors: Anders Kamf, East Amherst, NY (US); Lawrence Wojnicz, Kendsha, WI (US)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/203,194

(22) Filed: Nov. 30, 1998

(65) Prior Publication Data

US 2002/0088514 A1 Jul. 11, 2002

(51) Int. Cl.[7] ..... C22F 1/08
(52) U.S. Cl. ..... 148/684; 148/685; 148/687
(58) Field of Search ..... 148/684, 685, 148/687

(56) References Cited

U.S. PATENT DOCUMENTS 3,882,712 A * 5/1975 Shapiro et al. ..... 148/685
4,541,875 A * 9/1985 Woodard et al. ..... 148/554

FOREIGN PATENT DOCUMENTS

JP 54148112 * 11/1979

* cited by examiner

*Primary Examiner*—Sikyin Ip
(74) *Attorney, Agent, or Firm*—Morgan & Finnegan, LLP

(57) ABSTRACT

Processes for producing articles with stress-free edges which comprise slitting a copper or copper alloy sheet to provide strips of the copper material, heating the strips in a furnace at a temperature of 200–250° C. under a protective atmosphere, and cooling the strips to room temperature, the strips so produced being useful to make stamped articles.

14 Claims, No Drawings

PROCESSES FOR PRODUCING ARTICLES WITH STRESS-FREE SLIT EDGES

BACKGROUND OF THE INVENTION

This invention relates to a process for producing copper-based articles of manufacture that have stress-free edges and the article so produced.

Thin copper strips have a wide range of uses in commercial practice. They are used for instance to make terminals for electrical connectors. Other important uses include the manufacture of spring elements and the like. The copper strips are supplied to manufacturers ready for their use in making such various article of manufacture.

The manufacturers generally obtain copper strips in the form of pancake coils. A pancake coil is simply a long copper strip rolled into a coil. The manufacturer then uses a press, such as those made by Bruderer, Ridgefield, New Jersey or The Minster Machine Company, Minster, Ohio, to stamp the strip into the desired shape for the part to be made. The articles so produced can be simple springs, male terminals, or female terminals, for instance, in various configurations. After the stamping operation in the press, the parts remain attached to the original strip, which is called a carrier. The carrier can have shapes stamped at each edge or in many instances along one of the two edges. After stamping, the parts can be used as is, particularly if stamped from tinned copper. In other instances, the articles so produced are then plated with various corrosion resistant or other metals such as nickel, tin, or gold, to suit the end use of the copper articles.

During plating of the articles, they are still attached to the carrier strip and it is important that they pass through the various solutions and rinsing and drying steps without causing any problems. During the final operation, the parts so produced are removed or detached from the carrier strip. In the case where the articles are terminals, they are connected to electrical conductors such as wires and assembled into a plastic or other housing. Such connectors usually have a number of terminals.

For use in such stamping operations, as well as for the final product, it is important that the shape of the strip be stable with a minimum of burring, camber, twist, or coil set. Unfortunately, even a strip that appears satisfactory to visual inspection can create difficulties after the stamping operation. Thus, a strip can exhibit die exit camber or twist, especially if the carrier strip is only at one edge of the original strip.

A number of possibilities can explain such undesirable results. It could be that residual, hidden stresses remain in the strip received from the strip manufacturer. During the slitting operation used to prepare the strips from a copper coil, the edges of the strip may have been pinched off or sheared. Indeed, it is not possible to shear a strip without introducing stresses into the strip so produced. In such an operation a very small area along the edge of the strip has been elongated and would like to be longer than the strip. Since the area of the pinched edge is small, it does not create much distortion. However, the stresses caused by slitting this first edge can be roughly balanced by stresses in the other edge of the strip. Thus, a coil can appear to be straight until the stamping operation separates the edges.

The problem can be predicted in a number of ways. One way is to remove part of the strip by etching, but leaving the slit edges and adjacent metal untouched. If there is likely to be a problem, the remaining material will bend in different directions, depending upon the particular processing utilized.

Attempts have been made to ameliorate this problem. Normally, one of the operations is a stretch bend leveling which will reduce stresses and produce a flatter strip. This also improves the slitting operation on the coil. A good slitter with a looping pit or a slip core will allow the tension for each individual cut to be controlled. With these tools and a careful setup during slitting, it is possible to provide a product which can be stamped without a problem by the manufacturer. However, there are times when the design of the part of the die makes it difficult to stamp so that a seemingly perfect strip will result in problems with twist or camber

THE INVENTION

Accordingly, the present invention provides copper coil stock which does not encounter the twist and camber problems of prior art methods when it is used to make connectors, springs and the like. Briefly, the present invention provides a process for producing articles of manufacture having stress-free edges which process comprises slitting a coil of copper-based sheet to produce strips of the sheet, heating the strips in a furnace under a protective atmosphere to a selected temperature for a selected time to anneal the copper, and cooling the strip to room temperature.

It has been found that this simple operation provides copper strips in coils which strips when stamped and/or cut will not exhibit any camber or twist. Instead, the copper strips provided by the present invention can be used to produce articles of manufacture such as terminals, springs, and the like without such problems.

The term copper-based material is used herein to mean copper and a wide variety of copper alloys, which can be used in the practice of the present invention. For instance, in addition to electrolytic copper, copper alloys containing zinc or copper alloys containing tin can be treated according to the present process. Examples of copper alloys include the 200-series of alloys of copper and zinc and the 500-series of alloys of copper and tin. Specific alloys desirably used, in addition to copper itself, include C194, C230, C260, C422, C425, C510, C511, C519, C521, C1453, C19210, C50715, and C50725.

In addition to treating pancake rolls, the process of this invention is particularly useful for treating traverse wound copper sheet. A traverse roll is a slit copper strip wound onto a reel. In view of the temperature treatment according to the invention, the reel material must be one which will withstand the treatment temperature for the time required to complete that step of the process. A particularly useful material for the reels is mild steel.

It has been found that the temperature used in heating the coils of strips according to the invention can range from about 200° C. to about 250° C. If the temperature is much lower than 200° C., the desired result will not be obtained. At temperatures over about 250° C., there is a waste of energy and other undesirable side effects begin to occur. Temperatures in the range of from about 200 to 240° C. have been found to be especially preferred.

The time required for the heat treatment can range from about one hour to ten hours. Shorter times do not generally have the effect of significantly reducing the camber or twist in the copper strips. Longer times do not generally provide better results and they reduce the overall production rate of product. It is especially preferred in certain embodiments of the invention to maintain the copper strip rolls at the treatment temperature for four to eight hours.

While a wide variety of copper and copper alloy sheet can be treated, thicknesses of 10 to 20 mils (0.010–0.020 inches)

are generally used in the manufacture of terminals and springs. Thinner sheets do not have the strength required, and greater thicknesses become too stiff and heavy for the uses contemplated for copper strip stock prepared according to the invention.

A wide range of coil widths can be used for slitting. Generally, widths of 12 to 50 inches are used. The width of the slit strips themselves can also vary. In view of manufacturing requirements of those using the copper or copper alloy strip stock described herein, the width of the strips can range from one-quarter inch to four or more inches. The most desirable widths for the copper strips are from about one to two inches.

The copper strip material is annealed in a protective atmosphere. Argon, nitrogen, and other non-reactive gases can be used to protect the copper strips in the furnace. In some instances, it is desirable to use a reducing atmosphere to provide the best results. Thus, nitrogen containing from about one percent to 30 percent hydrogen is preferred. It is especially preferred to use a protective atmosphere of nitrogen containing from five to 25 percent hydrogen.

The following Examples are given to illustrate embodiments of the invention as it is presently preferred to practice it. It will be understood that these Examples are illustrative, and the invention is not to be considered as restricted thereto except as indicated in the appended Claims.

EXAMPLE I

A 40-inch diameter coil of 11.8-mil thick copper having a width of 24 inches is slit into pancake coils of strips having a width of one inch. The pancake coils are then placed in a batch furnace and the coils are protected with a mixture of five percent hydrogen in dry nitrogen as an inert atmosphere. The coils are then maintained at a temperature of about 200° C. and maintained at that temperature for six hours. The furnace is thereafter permitted to cool to room temperature, the inert atmosphere is vented, and the strip coils are then removed from the furnace. After this treatment, the coils are packed and delivered to manufacturers.

When the coils of this Example are used to manufacture springs, terminals, and the like, it is found that the parts produced by the stamping operations are flat. There is no twist or camber to the finished articles.

EXAMPLE II

It is also common for a manufacturer to require that the material be traverse wound. In such instances the coil is slit into strips and traverse wound on a steel reel. Then the traverse wound reels with the strips are placed in a batch furnace and protected with a mixture of 25 percent hydrogen and 75 percent nitrogen as an inert atmosphere. The reels are then maintained in the furnace at a temperature of 240° C. for six hours. The furnace is thereafter permitted to cool to room temperature, the inert atmosphere is removed, and the reels are then removed from the furnace. After this treatment, the reels so produced are packed and delivered to manufacturers.

Here again, the copper strips so produced are free of twist and camber when they are stamped to produce terminal strips.

Other methods of heating the strips can also provide satisfactory results. For instance, it is possible to use an induction furnace to raise the temperature of the strips to the required temperature for the required time. The protective atmosphere is used in any event.

What is claimed is:

1. A process for producing articles with stress-free slit edges, which method comprises slitting a coil of copper-based sheet to produce strips of the copper-based material, heating the strips in a furnace under a protective atmosphere at a temperature of from about 200° C. to about 250° C. for a period of time to free the strip of stresses, and cooling the strips while in the furnace until the furnace has cooled to room temperature, venting said protective atmosphere and removing said strips from said furnace.

2. A process according to claim 1 wherein the copper-based sheet is copper or a copper alloy.

3. A process according to claim 2 wherein the alloy is an alloy of copper and zinc or an alloy of copper and tin.

4. A process according to claim 1 wherein the temperature is from about 200° C. to about 240° C.

5. A process according to claim 1 wherein the heating is carried out for from one hour to ten hours.

6. A process according to claim 1 wherein the heating is carried out for from about four hours to about eight hours.

7. A process according to claim 1 wherein the protective atmosphere comprises an inert gas.

8. A process according to claim 1 wherein the protective atmosphere comprises nitrogen.

9. A process according to claim 1 wherein the protective atmosphere is a reducing atmosphere.

10. A process according to claim 9 wherein the atmosphere contains from about one to about 30 percent by volume of hydrogen.

11. A process according to claim 10 wherein the protective atmosphere contains from 70 to 99 percent by volume of nitrogen and the remainder of the atmosphere is hydrogen.

12. A process according to claim 1 wherein the width of the strips is from about one-quarter inch to four inches.

13. A process according to claim 1 wherein the width of the strips is from one to two inches.

14. A process according to claim 1 wherein the sheet thickness is from 0.010 to 0.020 inches.

* * * * *